US006176975B1

(12) United States Patent
Andersson et al.

(10) Patent No.: US 6,176,975 B1
(45) Date of Patent: Jan. 23, 2001

(54) HEADBOX

(75) Inventors: Tommy Göran Andersson; Nils Ulf Haraldsson; Ernst Tomas Svensson, all of Karlstad (SE)

(73) Assignee: Valmet-Karlstad AB, Karlstad (SE)

( * ) Notice: Under 35 U.S.C. 154(b), the term of this patent shall be extended for 0 days.

(21) Appl. No.: 09/231,462

(22) Filed: Jan. 14, 1999

Related U.S. Application Data

(60) Provisional application No. 60/075,648, filed on Feb. 23, 1998.

(30) Foreign Application Priority Data

Jan. 14, 1998 (SE) ..... 9800055

(51) Int. Cl.[7] ..... D21F 1/02

(52) U.S. Cl. ..... 162/212; 162/272; 162/336; 162/347

(58) Field of Search ..... 162/212, 272, 162/336, 347

(56) References Cited

U.S. PATENT DOCUMENTS

| | | | | |
|---|---|---|---|---|
| 3,313,681 | * | 4/1967 | Dennis et al. | 162/336 |
| 3,562,107 | * | 2/1971 | Schmaeng | 162/336 |
| 4,406,741 | * | 9/1983 | Kirjavainen | 162/336 |
| 5,565,064 | | 10/1996 | Grimm et al. . | |

FOREIGN PATENT DOCUMENTS

| | | |
|---|---|---|
| 1098748 | 4/1981 | (CA) . |
| 23 20 312 | 10/1974 | (DE) . |
| 43 28 997 | 12/1993 | (DE) . |
| 447 139 | 10/1986 | (SE) . |

* cited by examiner

*Primary Examiner*—Karen M. Hastings
(74) *Attorney, Agent, or Firm*—Alston & BIrd LLP

(57) ABSTRACT

A headbox in a paper machine, which headbox has a stock outlet for a jet of stock having a specific length, angle of impact and point of encounter in relation to a nip in the wet section of the paper machine, which headbox has two stand parts, lifting arms with front and rear journalling means and a device for setting the position and alignment of the headbox so that the stock jet obtains said specific length, angle of impact and point of encounter, which setting device has two actuators mounted pivotably at the rear Journalling means of the lifting arms and at the stand parts, whereby the headbox is adjustable by means of a turning movement about said front bearing means of the lifting arms. According to the invention the setting device has two bottom plates each arranged detachably, one at each of the stand parts; an actuator support at each side of the machine having a horizontal surface and situated downstream of said front journalling means; at least one movable actuator at each side of the machine; a horizontal pressing surface on each lifting arm above the surface of the actuator support, said pressing surface and the surface of the actuator support between them defining a space for receipt of the actuator which, upon activation, lifts the headbox from the stand parts to form a space between the stand parts and the bottom plate; and a stock of spacer plates for insertion into the space for adjustment of the headbox in vertical direction.

20 Claims, 7 Drawing Sheets

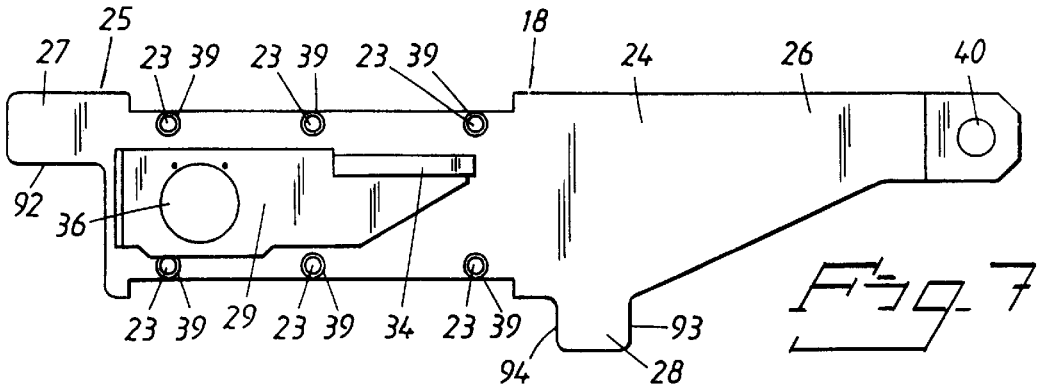
Fig. 7
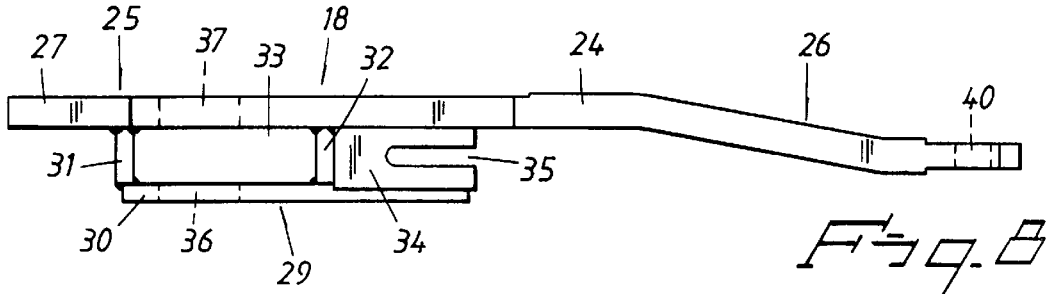
Fig. 8
Fig. 9
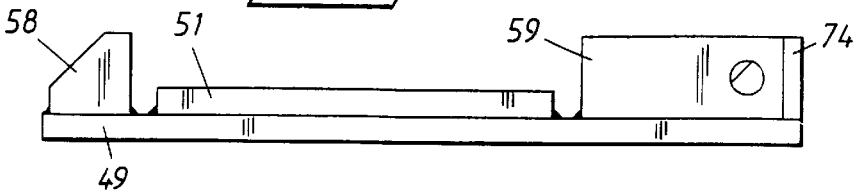
Fig. 10
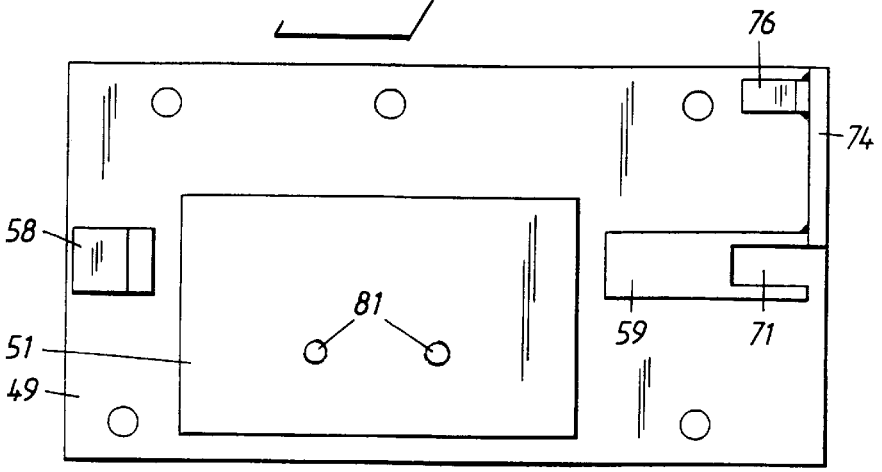

HEADBOX

CROSS-REFERENCE TO RELATED APPLICATIONS

This application claims the benefit of U.S. Provisional Application Ser. No. 60/075,648 filed Feb. 23, 1998.

FIELD OF THE INVENTION

The present invention relates to a headbox in a paper machine, and more particularly relates to headboxes which are positionally adjustable.

BACKGROUND OF THE INVENTION

If a paper web is to be well formed a good grammage distribution must be achieved, by which is meant a uniform distribution of fibers in the paper. Good formation improves drainage, pressing and drying and makes creping less prone to problems, while at the same time the paper becomes stronger and softer. The function of a headbox is thus to distribute the fiber suspension, the stock, in such a manner that said good formation is obtained. This is achieved by a jet of stock being delivered from the headbox through a stock outlet, the discharge opening, formed by upper and lower lips, so that the jet of stock encounters a forming wire in a forming zone. The paper web is then formed by water being drained out through the wire so that the layer of stock is gradually thickened to a continuous fiber network. To obtain a correct sheet structure with varying jet thickness, web speed or type of stock it is therefore of great significance that the stock is delivered in a manner carefully determined for a particular production since the drainage, and thus the formation, is greatly affected by where and how the stock jet encounters the wire, i.e., the angle of impact, the distance from the discharge outlet and the speed at which the stock jet encounters the forming wire.

To enable desired alteration of the point of encounter of the stock jet, its length and angle of impact, the headbox and its stock outlet must be adjustable. The thickness of the stock jet is regulated by means of setting devices which set the geometry of the lip opening. When the headbox is installed after exchanging, service, etc., it must be set in a position and aligned in relation to the forming zone so that said three parameters are correct.

The headboxes of soft paper machines do not differ in basic principle from other boxes, the box type depending on the speed range. Even at a low speed, i.e., above 300 m/min., closed hydraulic headboxes are used nowadays, which give a more stable profile and better formation. The speed into the hydraulic headbox is chosen so that good fiber distribution is obtained, and suitable turbulence intensity in the stock without unnecessary pressure losses. However, this requires the hydraulic headbox to be run with the flow for which it was dimensioned since a lower flow rate will give poorer fiber distribution and a poorer grammage profile. If the hydraulic headbox must be changed because a new optimal flow requires it, it must be possible to adjust the stock jet quickly and simply to a new position for the new hydraulic headbox.

Twin wire machines in which dewatering occurs between the twin wires have been known since the 70s. In essence this type of wire machine comprises a breast roll and a forming roll which rolls, together with said wires, form an inlet nip through which both wires then run together along almost 180° of the circumference of the forming roll, forming outer and inner wires. Only hydraulic headboxes are used as headboxes for twin wire machines and these hydraulic headboxes must be constructed so that they can be inserted into the nip between the wires since the free stock jet should not exceed a maximum length of about 250 mm, preferably about 100 mm. This is important so that the jet, which may have a speed of 1800–2000 m/min., is not broken up by turbulence before it encounters the forming wire. Even after deaeration, the stock jet contains undesired pressurized air bubbles which increase the risk of said turbulence arising, particularly at high machine speeds, since the air bubbles in the stock jet quickly expand when they emerge from the hydraulic headbox, thus disintegrating and deforming said jet. The lips are of approximately equal length, which contributes to facilitating adjustment of the stock outlet when the position of the headbox must be adjusted or re-set. Even so, said adjustment constitutes extremely complicated and time-consuming work due to the lack of space in said inlet nip and the hydraulic headbox must therefore first be adjusted roughly before any fine adjustment of the discharge opening can be carried out with the aid of setting devices.

The hydraulic headbox is placed close to the forming roll, just before the inlet nip, with its angle of impact and alignment carefully set. Since a very large part of the dewatering process occurs in the inlet nip, what happens there is extremely important to the forming of the paper.

The best formation is obtained if about 30–40% of the stock jet lies below the tangent to the forming roll in the direction of the jet so that part of the stock jet encounters the forming roll. This results in a pressure surge at the impact point which can, however, be regulated by lifting the jet so that its lower surface only touches the forming roll at a tangent. The more of the stock jet lying below the tangent to the forming roll the greater will be the pressure surge because more of the jet encounters said forming roll. The best position for the stock jet, and thus for the stock jet at different web speeds, stock concentrations and grades of paper with different requirements as to what constitutes an acceptable formation, must therefore be determined by trial and error. The setting device for the hydraulic headbox must also be so stable that the relation of the stock jet to the forming zone is not altered.

Several designs of twin wire machines are currently available, which differ from each other with regard to location of the hydraulic headbox, inclination of the nip, etc.

Depending on the design of the wet section, the stock jet can be directed downwardly, horizontally or upwardly. The wire mesh contains air which must be removed. An upwardly directed jet gives the best deaeration and the least risk of liquid splashes, but also has the drawback of more complicated dewatering. If, instead, the stock jet encounters the forming wire in an inclined, downwardly directed nip, while the wires are running upwardly over the forming roll, the dewatering takes place substantially downwards. All three alternatives are used with success.

If the stock jet is directed towards a desired point of impact it must be re-set or adjusted when trimming or regrinding the roll, after a roll exchange or wire replacement, etc. When replacing the wire, for instance, the headbox must be moved and with the bulky adjustment devices available today, this takes far too long. The hydraulic headbox must also be accessible for inspection and cleaning and must therefore be easily accessible so that it can be opened. A simple adjustment device, allowing all the above-mentioned configurations to be set, as well as efficient and quicker resetting after roll or wire replacement would be extremely profitable.

The machine manufacturers also at present build hydraulic headboxes capable of spraying two or three stock jets simultaneously into the nip between two wires, the individual jets being kept apart with the aid of wedges of air right up to the point of impact, and the length of the stock jets, i.e., the setting of the distance between the hydraulic headbox and the inlet nip, acquires increased significance.

The hydrodynamics become extremely important at the high speeds applicable for modem soft paper machines. Considerable demands are placed, for instance, on the hydraulic headbox being able to supply a stock jet having such well suppressed turbulence that it stays together until it reaches the nip between the wires. The direction and point of impact in this nip are then critical. Due to the cramped space between the inlet nip and the hydraulic headbox, adjustment of a new angle of impact while retaining the length of the jet may be extremely complicated. With the link system used today these small changes constitute a great problem since such small calibrations are not easy to perform without considerable risk of the hydraulic headbox coming into contact with and damaging the other equipment during this adjustment.

As mentioned above, a major part of the dewatering takes place in the inlet nip and it is thus of the utmost importance that the dewatering is correctly set here. This initial dewatering is directly depended on the angle of impact of the stock jet on the wire. Good formation is obtained if the fibers can be kept dispersed in the free stock layer until they are completely fixed in the growing fiber network without forming fiber flocks before then. This process is affected by the sort of stock being used at the time. Stock of different origin, such as hardwood or softwood, additives, temperature, etc. have different forming properties and it must therefore be possible to set different angles of impact and jet lengths depending on the current properties, and this must also be carried out quickly and cost-effectively since all standstills in production are extremely expensive. If dewatering takes place too slowly the turbulence in the stock layer will decrease and the risk of fiber flocks forming increases. If dewatering takes place too quickly, due to too sharp an angle of impact for instance, this will lead to the fiber network becoming fixed too early. The fiber bed will then be too dense and fibers can easily be drawn in and get caught in the meshes of the wire. This damages the paper and also clogs the wire. It must therefore be possible to set the angle of impact of the stock jet with extremely high precision, which is impossible with the bulky constructions available today. These constructions are simply unable to perform small alterations in a quick, stable and simple manner.

Generating turbulence in the stock layer during the active dewatering process which takes place for the most part immediately after encountering the wire and during passage of the wire through the inlet nip, disintegrates any fiber flocks that may have formed and prevents the occurrence of new ones, thereby improving the formation of the paper. The angle of impact of the jet, i.e., how much of the stock jet encounters the forming roll, with resultant variation of turbulence and stock pressure, has the most dominant effect on successful dewatering and thus also on the formation. Other factors affected by angle of impact are splashing water and difficulties removing the waste water.

Said adjustment of the headboxes has hitherto been performed with the aid of several different adjustment devices all of which, however, are extremely expensive. Canadian patent specification CA-1,098,748 describes a setting device comprising a link system consisting of a number of link arms operated by several actuators in a complicated manner. Furthermore, said link system supports the entire weight of the complete headbox construction and the construction elements are therefore extremely robust and expensive. Actuators in the form of light, small hydraulic or pneumatic piston type cylinders cannot be used since if a pressure drop were to arise due to the pivotable suspension this would immediately result in an altered angle of impact for the stock jet, and consequently deteriorated formation. Furthermore, since all movements in the described suspension arrangement consist of turning movements, the point of impact cannot be altered without simultaneously altering both the horizontal and the vertical position. Neither is it possible to maintain a predetermined length of the stock jet. With the heavy and ungainly constructions used here it is also completely impossible to obtain definite and exact movements with the aid of only link arms and actuators. The headbox must therefore be manipulated to and fro repeatedly before a more or less acceptable position can be obtained.

A headbox is also known through the published patent application SE-447 139 which is supported by forward and rear stand constructions on which horizontal sliding guides are arranged. The headbox can be displaced in a horizontal direction with the aid of a first actuator. Another actuator is arranged at the rear of the headbox which also enables turning about a shaft at the forward stand construction. The headbox can thus be displaced in a horizontal direction, which influences the jet length for instance, and can be turned about said forward shaft so that the angle of impact and point of encounter can be varied. However, the headbox cannot be moved vertically and this setting device is thus clearly restricted in its adjustment ability in relation to a fixed inlet nip.

German published patent application DE 43 28 997, finally, describes a setting device in which an attempt is made to manage said complex adjustment of both a desired direction and a specific point of encounter, while at the same time maintaining a predetermined stock jet length. The entire weight of both headbox and setting device is carried by the described actuator and its journalling means. It will be readily understood that such a setting device, which must be dimensioned to deal with extremely heavy loads, approximately 40 ton, requires an extremely strong and expensive construction. Since the center of gravity of the construction will vary depending on the location of the headbox, each element in the construction e.g., stock, actuator, etc., must be dimensioned for a plurality of movable and variable load cases where the weight of the entire adjusting device, including the headbox, in an extreme case is supported almost entirely exclusively by one of the elements, see FIG. 3 in the publication described here. The elements used will therefore be extremely over-dimensioned in comparison with if the loads were distributed more uniformly between part-elements. Problems therefore occur in fine-adjustment of the stock jet since the actuator cannot provide the accuracy and flexibility required. The setting device shown comprises at least three pairs of rigidly mounted jacks which make the construction more expensive and, due to the considerable loads, are subjected to considerable wear. Since the construction is suspended in a system of actuators, all of which are free to move in relation to each other, it is also difficult to suppress the unavoidable vibrations in a satisfactory manner.

A main object of the present invention is at least for the most part to eliminate the problems mentioned above and achieve an improved device for setting the position of a headbox so that its stock jet can be quickly, simply and reliably set in an optimal position in relation to its point of encounter, length and angle of impact in relation to a forming zone at the inlet nip to a twin wire machine.

Another object of the invention is to provide a device for setting the position of a headbox so that a paper web with good formation can be produced regardless of the type of stock or the rate of flow deemed optimal for the headbox design or wire configuration concerned.

Yet another object of the invention is to provide a device for setting a headbox so that all vibration and instability in the headbox is eliminated or at least greatly reduced.

Still another object of the invention is to provide a device for setting a headbox depending on the paper grade, pulp quality or machine speed, so that its alignment and distance can be adjusted as to height, length and inclination in a considerably simpler and more flexible manner, at a third of the normal cost.

SUMMARY OF THE INVENTION

The device according to the invention is characterized in that the setting device also comprises two horizontal bottom plates arranged detachably, one at each of the stand parts and supporting the lifting arms; a first, forward actuator support at each side of the machine which has a free, horizontal surface and is situated downstream of said front journalling means; at least one movable actuator at each side of the machine; a free, horizontal pressing surface formed on each lifting arm vertically above the surface of the forward actuator support; that said pressing surface and surface of the forward actuator support between them define a space for receipt of the actuator which, upon activation, has its opposite force-transmitting pressing surfaces in engagement with said pressing surface of the lifting arm and the surface of the actuator support for lifting the headbox from the stand parts after said bottom plate has been released from the stand part to form a space between the stand parts and the bottom plate released therefrom; and a stock of spacer plates for insertion into said space between the bottom plate and stand part in a specific number corresponding to the required adjustment of the headbox in vertical direction after the actuator has been deactivated.

An essential advantage of the invention is that the dimensions of the construction parts can in some cases be halved. The plate thickness of various supporting elements, for instance, can be reduced from 100 mm to 50 mm. The design according to the invention is thus not only much cheaper, about one third of the normal cost, but its handling is simplified since said construction weighs less and adjustment of the headbox thus becomes more efficient.

BRIEF DESCRIPTION OF THE DRAWINGS

The invention will be described in more detail with reference to the drawings.

FIG. 7 is a view of a detail of the lifting arm on the operator side, seen from the operator side.

FIG. 8 is a top view of the lifting arm according to FIG. 7 seen from above.

FIG. 9 is a side view of a bottom plate in the turn and slide means according to FIG. 5, showing a sliding plate and forward and rear stops for two substantially horizontally acting set screws.

FIG. 10 is a top view of the bottom plate shown in FIG. 9, seen from above.

DETAILED DESCRIPTION OF THE DRAWINGS

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
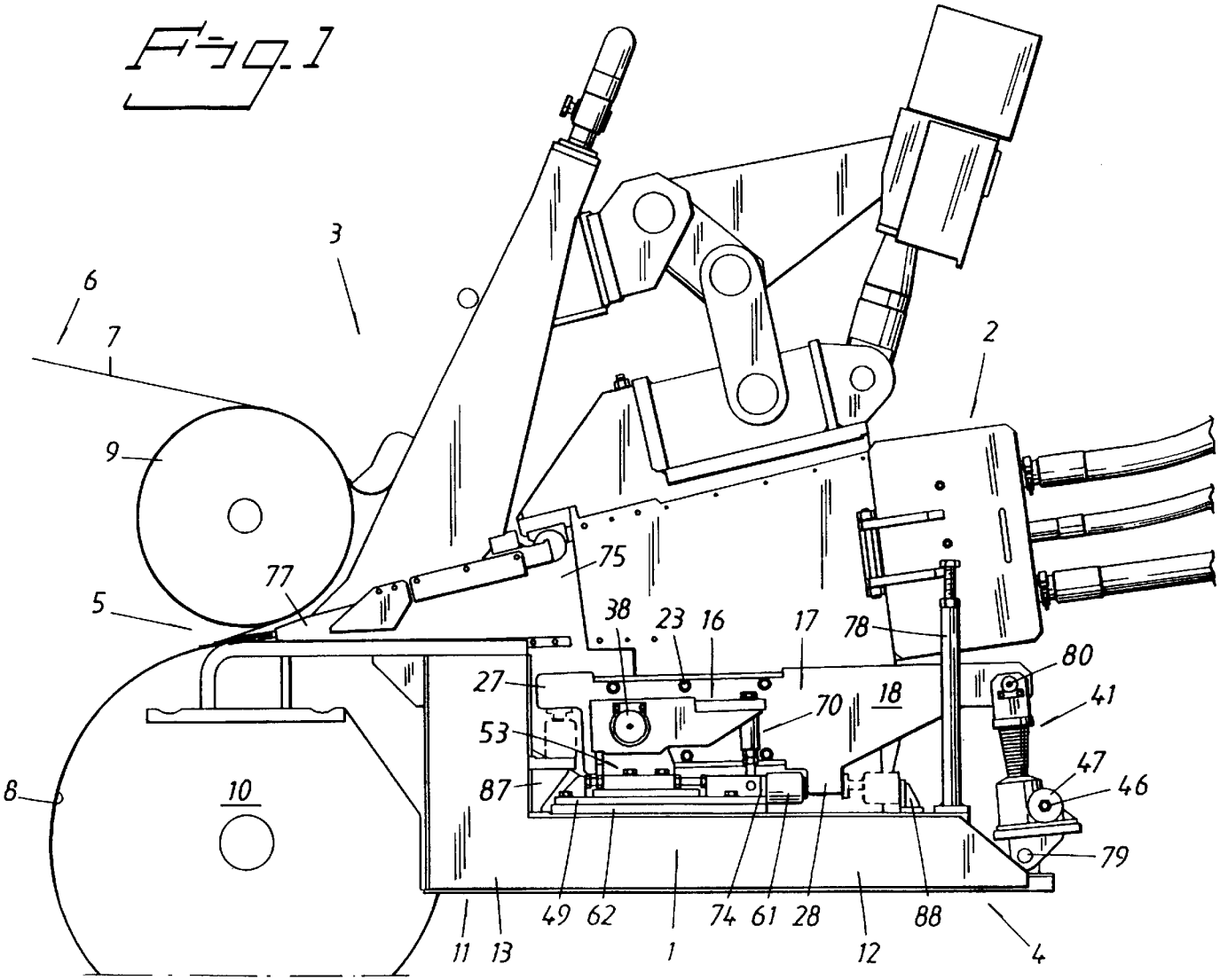
FIG. 1 is a schematic side view of parts of a wet section in a paper machine seen from the operator side comprising a twin wire machine with a headbox provided with a setting device according to the invention.

FIG. 1 shows schematically a side view of parts of a device 1 for adjustment of a headbox 2 in a paper machine 3, seen from the operator side 4. The headbox 2 has a housing 75 with a nozzle chamber and a stock outlet with a slice 77 in the form of a discharge opening for delivering a single or multi-layered jet of stock. The headbox 2, which in the embodiment shown is a hydraulic headbox, is situated close to an inlet nip 5 of a twin wire machine 6 in which dewatering occurs between an outer wire 7 and an inner wire 8. Said twin wire machine 6 comprises a breast roll 9 and a forming roll 10, which rolls 9, 10, together with the wires 7, 8, form said inlet nip 5 through which the two wires 7, 8 run jointly around a large part of the circumference of the forming roll 10.

The setting device 1 comprises a stand construction 11 connected to the rest of the machine stand 12 of the paper machine 3 in a stable and, as far as is technically possible, vibration-free manner. The stand construction 11 is also so designed that the headbox 2 is easily accessible for trimming, adjusting and service. According to the embodiment shown, see FIGS. 1 and 3, the stand construction 11 comprises two stand parts 13, 14 arranged at the operator side 4 and the drive side 15 of the paper machine 3, between which stand parts 13, 14 the wires 7, 8 of the twin wire machine 6 run below the headbox 2. Should a different wire draw be deemed more advantageous it can of course be arranged within the scope of the present invention. Such alternative draw can then suitably be obtained by arranging one or more guide rolls (not shown) for said wires 7, 8 in the vicinity of said headbox 2.

Figure 2:
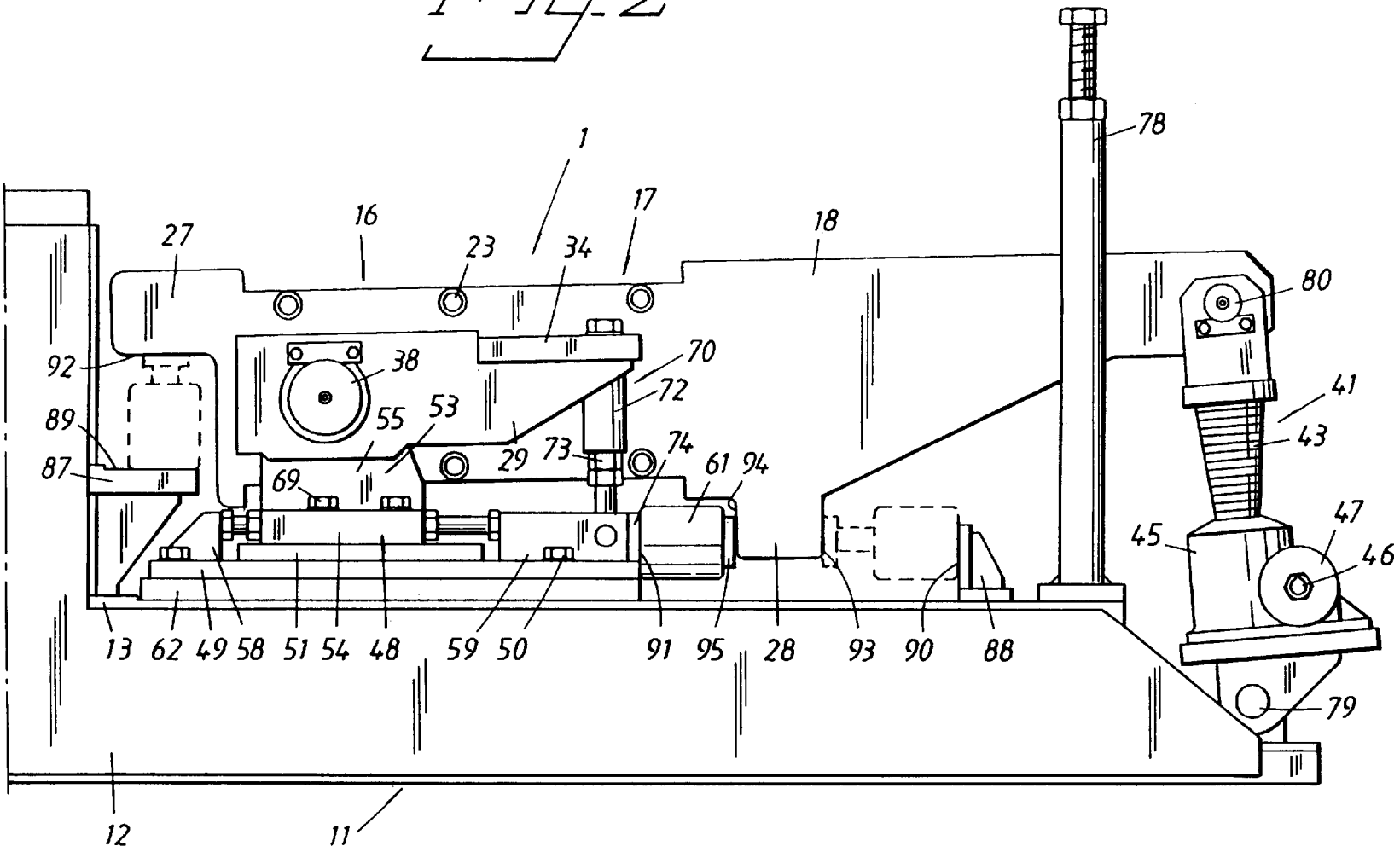
FIG. 2 is a schematic side view of parts of the setting device according to FIG. 1 seen from the operator side and showing a lifting arm arranged pivotable to a rear actuator, and to a turn and slide means, a number of movable actuators and a locking device.
Figure 3:
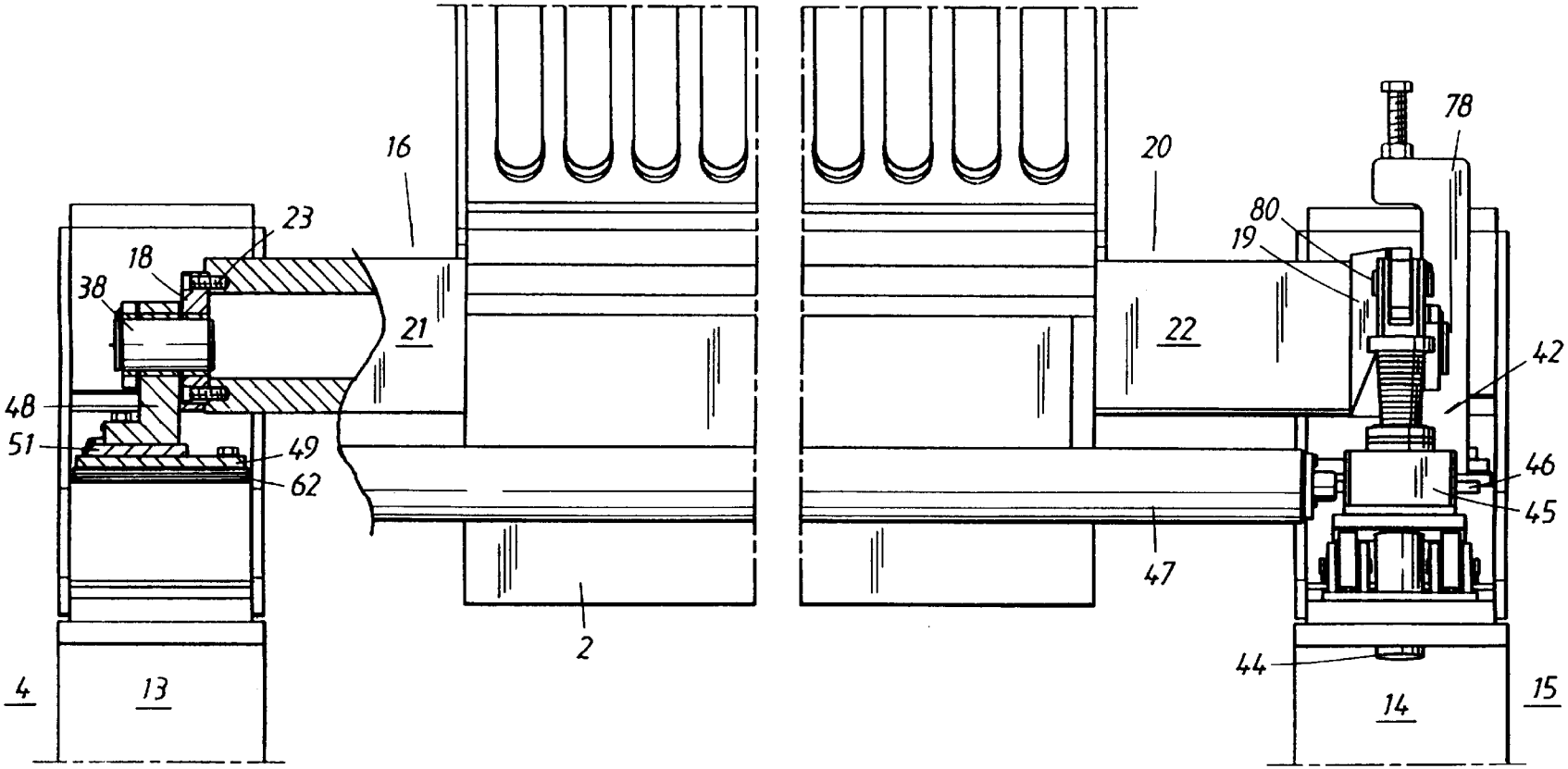
FIG. 3 is a schematic end view of parts of the headbox and its setting device according to FIG. 1, seen upstream of the twin wire machine and with parts of the operator side cut away.
Figure 4:
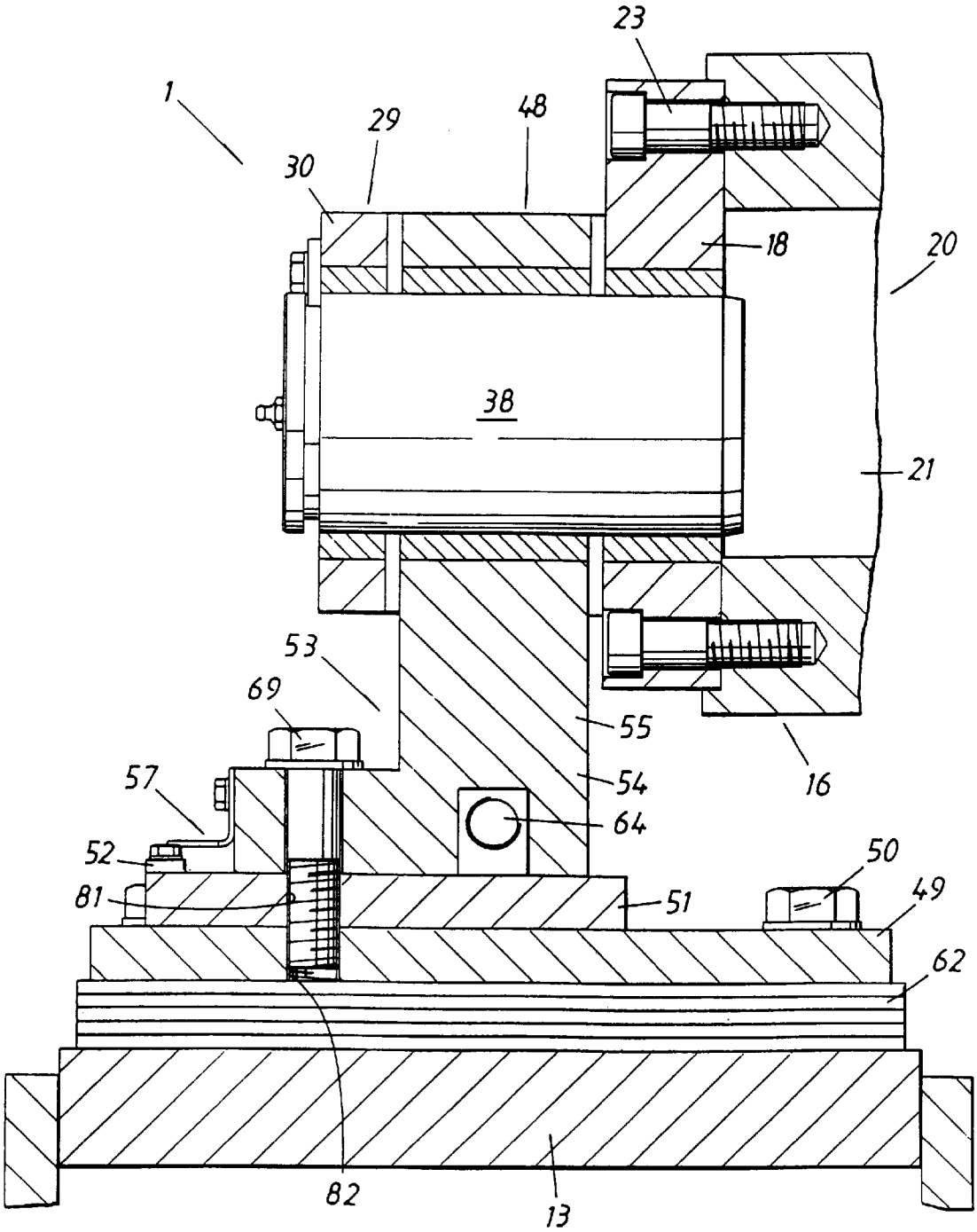
FIG. 4 is a cross section of a detail in the turn and slide means on the operator side, according to FIG. 3.

As is clear from FIGS. 2, 3 and 4, the setting device 1 comprises a frame construction 16 supporting the headbox 2, said frame construction comprising a lifting device 17 having two lifting arms 18, 19, suitably arranged one on each side of the headbox 2. The frame construction 16 also comprises an elongate support member 20 arranged substantially perpendicular to the direction of the machine and connecting said lifting arms 18, 19 to the headbox 2. In the embodiment shown the support member 20 consists of two box beams 21, 22 extending between the inner sides of said lifting arms 18, 19 and to sides of the headbox 2 opposite thereto, the attachment of the box beams 21, 22 to said lifting arms 18, 19 consisting of a screw joint 23 (see FIG. 2). However, this attachment may be achieved by any other suitable joint such as weld or rivet joints, if so desired.

When corresponding construction elements occur on both the operator side 4 and the drive side 15 of the paper machine 3, only the construction element on the operator side 4 will be discussed in the following description since the difference between said elements is only that they are mirror-inverted in relation to each other.

The terms "forwards" and "backwards", "forward" and "rear", "downstream" and "upstream", etc., shall be understood to mean movements, directions or positions in relation to the machine direction or the inlet nip 5.

Figure 6:
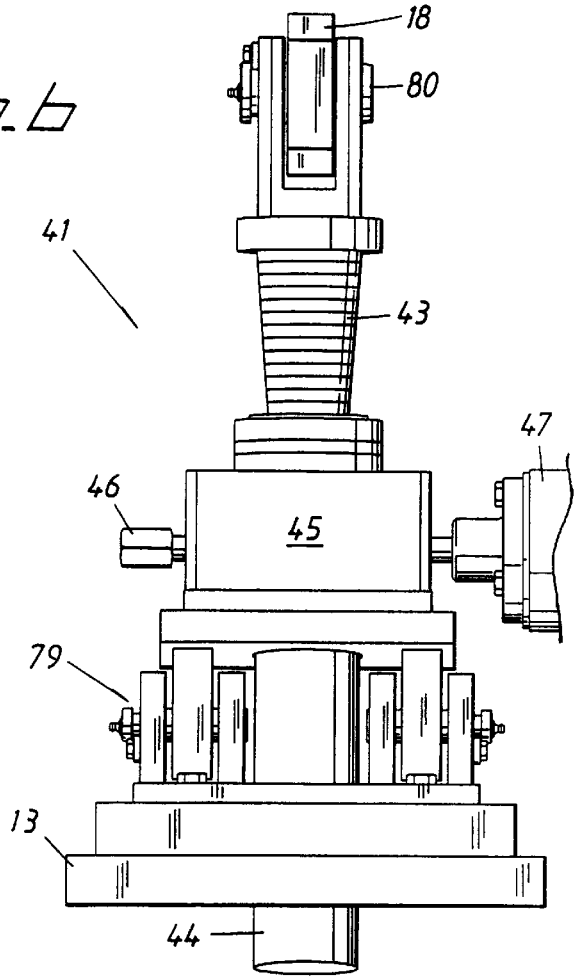
FIG. 6 is a view of a detail of the rear actuator on the operator side, according to FIG. 1.

As is clear in FIGS. 7 and 8, each lifting arm 18, 19 comprises an elongate body 24, the appearance and cross-sectional shape of which are adapted to the other construction elements with which it is to cooperate and to the loads to which it will be subjected. The elongate body 24 has a forward end 25 and a rear end 26. Each lifting arm 18, 19 also includes a yoke member 29 arranged in the forward-half of the lifting arm 18, 19 and attached to its vertical outer side facing away from the headbox 2. The yoke member 29 comprises three rectangular, vertical plate elements 30, 31, 32, of which a first plate element 30 is arranged spaced from and substantially parallel with said lifting arm 18, 19, while the other two plate elements 31, 32, with substantially the same dimensions, are attached to the vertical outer side of the lifting arm 18, 19 facing away from the headbox 2, forming a vertical, through-running cavity 33 with the first plate element 30. A locking element 34, the purpose of which is described in more detail below, is also secured both to the upper side of the yoke member 29 and to the outer side of the lifting arm 18, 19. This locking element 34 comprises a longitudinal groove 35, open rearwards, and running substantially parallel and coaxially with the through-cavity 33. Two circular through-openings 36, 37 are also arranged coaxially with each other, one of which openings 36, is in the first plate element 30 and the other opening 37 in the lifting arm 18, 19. The openings 36, 37 are arranged to receive a forward journalling means 38, e.g., comprising a pivot pin or pivot shaft, including sleeves therefor. A suitable number of holes 39 for said screw joints 23 to the elongate support member 20 are also provided in the mid-section of the lifting arm 18, 19. In the embodiment shown in FIG. 7 the number of holes is three, situated in a row along the upper and lower edges, respectively, of the lifting arm 18, 19. As mentioned previously, weld joints or rivet joints may be chosen instead if so desired. This also applies to all other permanent joints. Another hole 40 is provided in the rear portion 26 of the lifting arms 18, 19. The setting device comprises rear, mechanical actuators 41, 42 connected to the lifting arms 18, 19 at said hole 40. In the embodiment shown the actuators 41, 42 consist of mechanical screw jacks. Each screw jack 41, 42 is pivotably mounted at its lower and upper ends in the lifting arms 18, 19 and stand parts 13, 14 by means of suitable journalling means 79, 80. Each screw jack 41, 42 comprises a pivotable spindle or a gear rack displaceable in substantially vertical direction, which is surrounded by a protective helical bellows 43 and a protective tube 44 at its upper and lower portions, respectively, (see FIG. 6), which portions are located outside a transmission box 45 suitably arranged at the middle of the gear rack. The transmission box 45 houses transmission means for conversion of an applied rotary movement to an axial movement. At least on the operator side 4 a gripping member 46 protrudes from said transmission box 45, by means of which gripping member 46 the rear actuator 41, 42 can be operated in vertical direction so that the headbox 2 can be turned about the forward journalling means 38 of the lifting arms 18, 19. A parallel shaft 47 connecting the transmission means to each other, extends between the rear actuators 41, 42 so that a synchronized and uniform turning movement can be obtained on the operator side 4 and drive side 15.

Figure 5:
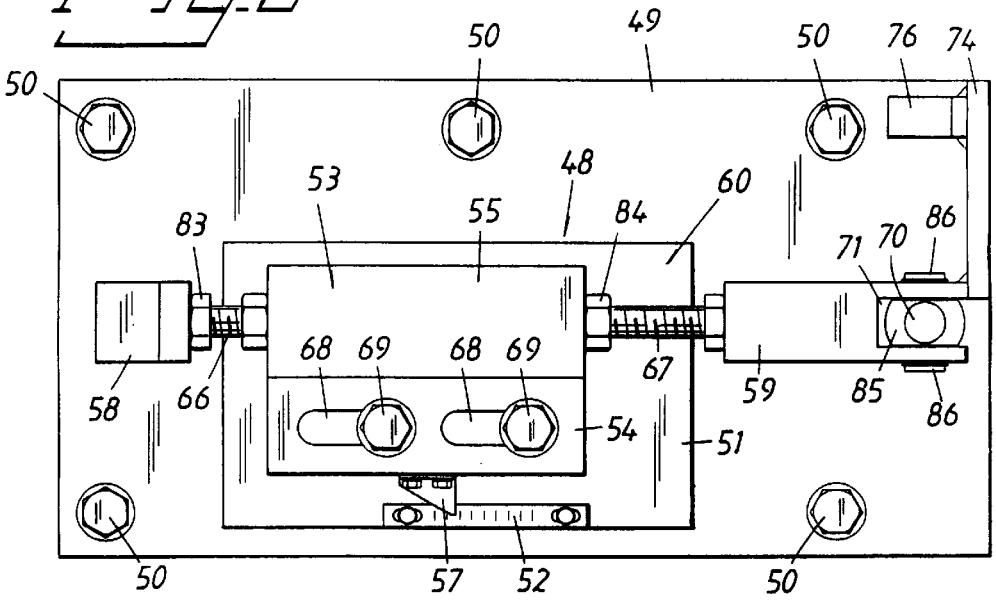
FIG. 5 is a top view of parts of the setting device according to FIG. 1, seen from the front, showing the turn and slide means of the operator side and a locking device which secures this.
Figure 12:
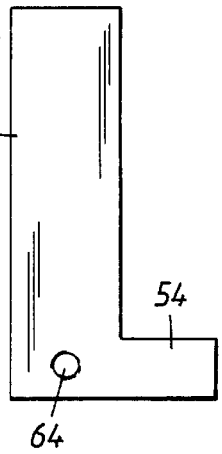
Figure 13:
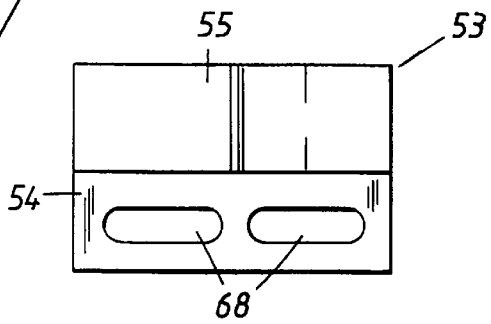
Figure 14:
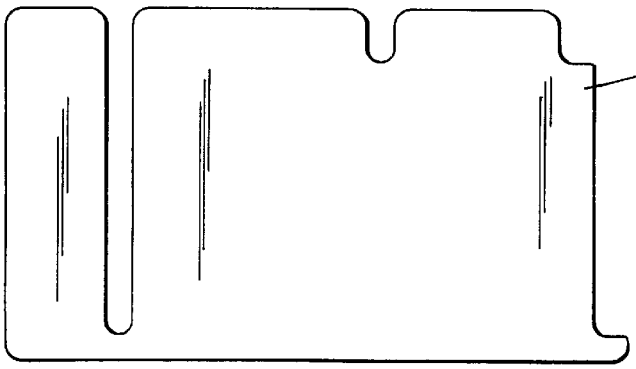
FIG. 14 is a top view of a spacer plate included in the setting device according to FIG. 1.
Figure 15:
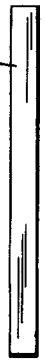
FIG. 15 is a side view of the spacer plate according to FIG. 14, seen from the inlet nip.

As clear from FIGS. 4 and 5, a turn and slide means 48 is arranged on each side of the machine 4, 15, resting on a bottom plate 49 which is detachably secured to the stand part 13, 14 by several bolts 50. The bottom plate 49 supports a sliding plate 51 on which a suitable scale of measurement 52, such as a steel rule, is mounted on the side facing the operator side 4 and drive side 15, respectively, and parallel to the machine direction. Each turn and slide means 48 comprises a support lug 53 which consists of a horizontal sliding part 54 (see FIGS. 11–13) which rests on the sliding plate 51 of the bottom plate 49, and a vertical holder part 55 with its vertical plane parallel to the machine direction and attached eccentrically to the upper side of the horizontal sliding part 54. The vertical holder part 55 has an opening 56 to receive the forward journalling means 38 of the lifting arm 18, 19 and is arranged to be inserted into the cavity 33 located between the yoke member 29 and the lifting arm 18, 19 so that the journalling means 38 can be inserted through the yoke member 29, holder part 55 and lifting arm 18, 19 to form a pivotable joint. The horizontal sliding part 54 has a pointer 57 cooperating with the scale 52 so that each displacement of the support lug 53, and thus of the headbox 2, in the machine direction can be read.

As can be seen in FIG. 5, each bottom plate 49 has a forward counter-support 58 and a rear counter-support 59, which counter-supports are rigidly anchored, e.g., by welding, to the bottom plate 49. Between the bottom plate 49 and stand part 13, 14 are one or more spacer plates 62, the total building height being chosen for adjustment of the turn and slide means 48 to a position where the headbox 2 is at the desired level.

Figure 11:
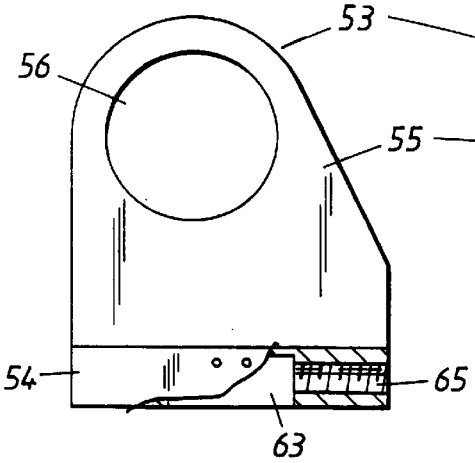
FIGS. 11, 12 and 13 are views of a detail of a support lug on the turn and slide means according to FIG. 4, seen from the operator side, the inlet nip and from the front, respectively.

The horizontal sliding part 54 and vertical holder part 55 of the support lug 53 are rigidly connected together to an L-shaped unit. FIG. 11 shows the opening 56 in the holder part 55 of the support lug 53 that receives the forward journalling means 38 of the lifting arm 18, 19. Immediately below the vertical holder part 55, in the sliding part 54, is a central recess 63 to which two coaxial, tapped holes 64, 65 are connected for receipt of set screws 66, 67, respectively, which form part of a locking device 60. The recess 63, like the holes 64, 65, is aligned in the machine direction. The sliding part 54 is also provided with two slots 68 arranged one after the other in the machine direction, beside the vertical holder part 55. The support lug 53 is secured to the bottom plate 49 by attachment screw 69 (see FIG. 4) extending through the slots 68 in the sliding part 54 and screwed into tapped holes 81, 82 in the sliding plate 51 and bottom plate 49.

The locking device 60 is intended to ensure that the position and direction of the headbox 2 are firmly fixed each time a setting has been performed. It comprises said horizontal set screws 66, 67 (see FIGS. 2 and 5), which are arranged in line with each other. The setscrew 66 acts between the support lug 53 and counter-support 58, whereas the setscrew 67 acts between the support lug 53 and the counter-support 59. The setscrews 66, 67 are screwed into the tapped holes 64, 65 in the support lug 53 so that their heads abut the forward counter-support 58 and rear counter-support 59, at said fixing. The reference numbers 83, 84 denote locking nuts which, in active position, prevent the setscrews 66, 67 from turning.

The locking device 60 also comprises a substantially vertical set screw 70 with head 85 which is received in a recess 71 in the rear end of the counter-support 59 and is pivotably journalized at the counter-support 59 by means of a shaft pin 86. The vertical set screw 70 extends up to the locking element 34 at the yoke member 29 of the lifting arm 18, 19. It comprises a stop ring 72 (see FIG. 2) and a plurality of nuts 73 which are arranged so that the stop ring 72 can be clamped against the lower side of the locking element, enabling the lifting arm 18, 19 to be locked in the position set. In the embodiment shown the setting device 1 comprises one movable actuator 61 and three actuator supports 87, 88, 74 on each side 4, 15 of the machine, i.e., a first, forward actuator support 87 secured to the stand part 13, 14, a second, rear actuator support 88 secured to the stand part 13, 14, and a third, middle actuator support 74 carried by the bottom plate 49 and secured thereto. More than one movable actuator 61 may be arranged at each machine side 4, 15 if desired. Each lifting arm 18, 19 is provided with three pressing surfaces 92, 93, 94 (see FIG. 7) situated a predetermined distance from and immediately opposite one of the actuator supports 87, 88, 74. In the embodiment shown each lifting arm 18, 19 is provided with a horizontal, forwardly protruding projection 27 at the forward end 25 and a vertically, downwardly protruding projection 28. At the horizontal projection 27 is said pressing surface 92 which is horizontally extending and facing downwards, whereas the other two pressing surfaces 93, 94 are on the vertical projection 28 and have vertical extension. The third, middle actuator support 74 extends transversely to the machine direction and is permanently connected, e.g., by welding, to the bottom plate 49 and the rear end of the counter-support 59 as well as with a reinforcing element 76 welded to the bottom plate 49 at its rear comers seen from the operator side 4 and drive side 15 respectively (see FIGS. 9 and 10).

The first, forward control actuator support 87 is arranged at the forward end portion of the stand part 13, 14 and has a horizontal surface 89 situated vertically below and at a predetermined distance from the horizontal pressing surface 92 of the horizontal projection 27 to allow sufficient space for the movable actuator 61 (shown in phantom in FIG. 2) to be inserted between them. The second, rear actuator support 88 is arranged at the rear end portion of the stand part 13, 14 and has a vertical surface 90 situated upstream and at a predetermined distance from the rear vertical pressing surface 93 of the vertical projection 28 to allow sufficient space for insertion of the movable actuator 61 (again shown in phantom in FIG. 2) between them. The middle actuator support 74 is thus situated between the forward and rear actuator supports 87, 88 and has a vertical surface 91 situated downstream and at a predetermined distance from the forward vertical pressing surface 94 of the vertical projection 28 to allow sufficient space for insertion of the movable actuator 61 between them. The actuator 61 has a press element 95 that protrudes from its power-building body so that the actuator 61 with its opposing pressure-transmitting pressing surfaces acts with controlled force against the pressing surfaces 92, 93, 94, the actuator 61 being supported by the relevant fixed actuator support 87, 88 or 74. With reference to the present invention the expression "movable actuator" means that the actuator 61 is not rigidly connected to any construction part of the headbox 2 or its setting device 1, but is in free contact with the opposing surfaces 89, 92; 90, 93; or 91, 94, respectively, so that the actuator 61 is manually inserted into and removed from the space defined by said opposing surfaces 89, 92; 90, 93; and 91, 94, respectively.

The movements of the discharge opening 77 of the headbox 2 are kept within the maximum permissible limits at the inlet nip 5 to the twin wire machine 6 by the vertical turning movements of the lifting arms 18, 19 being limited downwards by each machine part 13, 14 and upwards by a stop member 78 (see FIGS. 1 and 2) for each lifting arm 18, 19, said stop member being vertically adjustable and suitably arranged in the vicinity of each rear mechanical actuator 41, 42.

The function of the setting device 1 is as follows: depending on the angle of impact, point of encounter and length of the stock jet desired, movement of the headbox 2 must occur in at least one of several directions comprising a substantially vertical movement upwards or downwards, a substantially horizontal movement forwards or backwards and also a movement achieved by turning the headbox 2 about the journalling means 38. Usually a combination or a repetition of at least two of said movements are performed in sequence before the parameters striven after for the stock jet can be achieved. If, for instance, a somewhat steeper angle of impact is desired for the stock jet, while maintaining the point of encounter in the nip 5 of the twin wire machine 6, at the same time as a somewhat increased stock jet length, the headbox 2 must be moved horizontally backwards, vertically upwards and also turned about its journalling means 38 in suitable sequence. Adjustment of the headbox 2 can be initiated, for instance, by moving it backwards a certain distance from the nip 5, thus creating increased space for the movement of the discharge opening 77 in or at the nip 5 of the twin wire machine 6. To achieve this the attachment screw 69 of each support lug 53 to the bottom plate 49 and the horizontal set screws 66, 67 are unscrewed to enable horizontal sliding between the sliding part 54 of the support lug 53 and the sliding plate 51 of the bottom plate 49. The movable actuator 61 at each machine side 4, 15 is placed at the middle actuator support 74, arranged at the rear part of the bottom plate 49, with its direction of force exertion towards the vertical projection 28 of the lifting arms 18, 19, after which the two actuators 61 are activated so that the two lifting arms 18, 19, together with the two turn and slide means 48, are displaced horizontally rearwards away from the nip 5. At this displacement, seen from the operator side 4, the two mechanical screw jacks 41, 42 are turned clockwise both about their lower journalling means 79 arranged at each machine stand part 13, 14, and also about their upper journalling means 80 arranged at the rear end part 26 of each lifting arm 18, 19. The parallel shaft 47 which cooperates with and extends between the two screw jacks 41, 42 thus ensures that the synchronized movements on the operator side 4 and the drive side 15 are synchronized with each other. Before and/or after the lifting of the headbox 2 described below, the actuator 61 can be moved to act between and against the rear actuator supports 88 and the vertical projections 28 in order to move the headbox 2 a desired distance towards the nip 5 with the object of adjusting the distance of the discharge opening 77 to the nip 5 or the point of encounter of the stock jet. The horizontal set screws 66, 67 of the support lug 53 and the attachment screws 69 are then tightened so that no further horizontal movement of the support lugs 53 can occur, after which the attachment bolts 50 of the bottom plates 49 are unscrewed from the stand parts 13, 14. The movable actuator 61 is then placed at the two rear actuator supports 87 fixed to the stand parts 13, 14 and caused to act against the horizontal projection 27 of the lifting arms 18, 19 to lift the turn and slide means 48 together with the bottom plates 49 screwed on (the attachment screws 69 are tightened). Lifting is continued until sufficient space is obtained below the bottom plates 49 for a suitable number of spacers 62 of predetermined thickness to achieve the desired height difference, to be inserted between the bottom plates 49 and the stand parts 13, 14, after which the actuator 61 is inactivated so that the headbox 2 is lowered slightly depending on the clearance, to assume its new level. The attachment bolts 50 are again screwed into the stand parts 13, 14 after which a final alignment of the slice 77 with regard to angle of impact is performed by turning the headbox 2 about the forward journalling means 38 of the lifting arms 18, 19 by activating the two rear actuators 41, 42 with the aid of the gripping device 46 arranged on the operator side 4 after the set screws 70 have been unscrewed. After this alteration in the angle of the headbox 2 the setscrews 70 are again tightened. Said horizontal displacement may of course be preceded by said turning or by the vertical displacement if desired. Further adjustment of the stock jet in relation to the nip 5 comprising altered angle of impact, length of stock jet and/or point of encounter is performed in the manner described above with linear displacement and turning performed consecutively with the aid of the movable actuators 61 and the rear actuators 41, 42.

The alignment and position of the headbox 2 can thus be varied in an extremely simple, efficient and accurate manner, and the whole weight of the headbox 2 can rest firmly on the stand 12 while the paper machine 3 is in operation so that the previous vibrations, involuntary changes in position of the headbox 2 and all the other problems of conventional setting devices mentioned in the introduction, such as unstable link systems with large, bulky jacks, can be eliminated.

The actuators 61 required to move the headbox 2 are advantageously of the pneumatic, hydraulic or electric type which, compared with the considerably larger, fixed mechanical jacks used previously, are easy to manipulate. The actuators 61 of the setting device 1 according to the invention can therefore easily be moved by a single operator from one actuator support 74, 87, 88 to another.

It will be understood that the dimension, placing and form of the elements included in the setting device 1 described above, such as spacer plates 62, screws, lifting arms 18, 19, etc., can be adapted to either the operator side 4 or the drive side 15, as well as to the form and relative positions of the other elements included in the construction.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. An adjustable headbox apparatus for issuing a jet of stock to a paper machine, said headbox apparatus comprising:

a stand part arranged at either transverse side of the paper machine;

a headbox having a pair of opposed transverse ends, each disposed adjacent to the respective stand part, the headbox also having a forward stock outlet end and a rearward end in a machine direction;

a bottom plate operably engaging each transverse end of the headbox so as to support the headbox on the respective stand part, said bottom plates each having a forward end and a rearward end in the machine direction and being movable in relation to the respective stand part;

at least one setting device operably engaging the bottom plates and being capable of supporting at least part of the weight of the headbox, the at least one setting device being adjustable, whereby the at least one setting device can be adjusted so as to upwardly separate the rearward ends of the bottom plates from the stand parts;

at least one movable actuator operably engaged between the forward ends of the bottom plates and the stand parts, the at least one actuator being actuatable, whereby actuation of the at least one actuator upwardly separates the forward ends of the bottom plates from the stand parts and, in cooperation with the at least one adjustable setting device, forms a space between each bottom plate and the respective stand part;

at least one spacer plate configured to be inserted into the spaces between the bottom plates and the stand parts to create a predetermined thickness corresponding to a desired adjustment of the headbox in a vertical direction upon deactuation of the actuator, and wherein the headbox is structured to be vertically, horizontally and angularly adjustable.

2. An adjustable headbox apparatus as claimed in claim 1 further comprising at least one lifting arm attached to said headbox and at least one journal, the at least one journal having an axis and being operably engaged between the transverse ends of said headbox and the bottom plates for pivotally supporting said headbox and lifting arm on said bottom plates, said lifting arm having a pair of opposed ends in the machine direction with one end attached to said adjustable setting device to allow setting of the angular orientation of the headbox about the axis of said journal.

3. An adjustable headbox apparatus as claimed in claim 2 further comprising a frame construction to support the headbox, said frame construction comprising a pair of said lifting arms and at least one elongate support member arranged substantially perpendicular to the direction of the machine and connecting said lifting arms to the headbox.

4. An adjustable headbox apparatus as claimed in claim 2 further comprising a support lug for supporting each of said journals, said support lug being detachably mounted on said bottom plates.

5. An adjustable headbox apparatus as claimed in claim 4 wherein each support lug further comprises a horizontal sliding part and a vertical holder part for holding the journal, and wherein a number of recesses are provided in the sliding part along the vertical holder part, through which recesses attachment screws are detachably arranged for cooperating with said bottom plate and fixing the support lug in place.

6. An adjustable headbox apparatus as claimed in claim 2 wherein said bottom plates are detachably secured to the respective stand parts by detachable attachment bolts.

7. An adjustable headbox apparatus as claimed in claim 6 further comprising:

a first front actuator support mounted on at least one of the stand parts for supporting said actuator;

a second rear actuator support mounted on at least one of the stand parts; and a third middle actuator support mounted to at least one of said bottom plates;

said rear and middle actuator supports each having a free, vertical surface corresponding to two free vertical pressing surfaces facing away from each other defined by said lifting arm so as to form spaces between them for insertion of the actuator such that the headbox can be moved horizontally as required away from the paper machine or towards the machine after said bottom plates have been released from the stand parts.

8. An adjustable headbox apparatus as claimed in claim 7 wherein said lifting arm further comprises a horizontal pressing surface opposing said front actuator support, said actuator acting therebetween to upwardly separate the forward ends of the bottom plates from the stand parts.

9. An adjustable headbox apparatus as claimed in claim 8 wherein said horizontal and vertical pressing surfaces of the lifting arms are provided on a forwardly directed protrusion and a downwardly directed protrusion, respectively.

10. An adjustable headbox apparatus as claimed in claim 2, further comprising a gripping member arranged, at least on the operator side of the headbox, by means of which gripping member said adjustable setting device is arranged to be operated so that the headbox can be turned about the journal of the lifting arms, and also a parallel shaft which is arranged to extend between adjustable setting devices at each side of the headbox so that said turning will be synchronized and uniform.

11. An adjustable headbox apparatus as claimed in claim 4 further comprising front and rear counter-supports arranged at each bottom plate, said counter-supports constituting fixed positions for a locking device comprising a plurality of set screws whereby the lifting arm can be locked in a set desired position with the aid of a locking element arranged at the lifting arm and also said counter-supports.

12. An adjustable headbox apparatus as claimed in claim 11, wherein said set screws comprise both horizontal set screws arranged coaxially one after the other between the front and rear counter-supports and the support lug, into which support lug the horizontal set screws are screwed, and also at least one additional substantially vertical set screw which is pivotally mounted on the rear counter-support, wherein the vertical set screw which extends up to said locking element on the lifting arm comprises a stop ring, and also a number of nuts, which set screws can be locked to the lifting arm in its set position both by said horizontal set screws abutting closely against said front and rear counter-supports and also by said stop ring being clamped to said locking element by means of said nuts.

13. A method of adjusting a trajectory of a jet of stock issuing from a headbox to a paper machine, the headbox having a pair of opposed transverse ends, each disposed adjacent to a respective stand part, and a bottom plate operably engaging each transverse end of the headbox so as to support the headbox on the respective stand part, the bottom plates each having a forward end and a rearward end in a machine direction and being movable in relation to the respective stand part, said method comprising the steps of:

adjusting a setting device operably engaging the bottom plates, and thereby supporting at least part of the weight of the headbox, such that the rearward ends of the bottom plates are upwardly separated from the stand parts;

actuating an movable actuator operably engaged between the forward ends of the bottom plates and the stand parts so as to upwardly separate the forward ends of the bottom plates from the stand parts, wherein adjusting the setting device and actuating the actuator cooperably forms a space between each bottom plate and the respective stand part;

inserting at least one spacer plate between the bottom plates and the stand parts;

deactuating the actuator so that the bottom plates are lowered to rest on the spacer plate to thereby adjust a position of the headbox in a vertical direction and wherein the headbox is structured to be vertically, horizontally and angularly adjustable.

14. A method as claimed in claim 13 comprising the further step of adjusting the angular position of the headbox by pivoting a lifting arm connected to the headbox on a journal rotatably supported on a support lug movably and operably engaging each bottom plate.

15. A method as claimed in claim 14 comprising the further step of horizontally adjusting the position of the headbox by sliding the support lug relative to the bottom plate.

16. A method as claimed in claim 13 comprising the further step of fixing the bottom plate to the stand plate after said deactuating step with detachable attachment bolts.

17. A method as claimed in claim 15 wherein said horizontal adjusting step comprises:

positioning a movable actuator against the lifting arm in a first position; and actuating the movable actuator to move the headbox in one horizontal direction.

18. A method as claimed in claim 17 wherein said horizontal adjusting step further comprises:

repositioning the same movable actuator against the lifting arm in a second position; and actuating the movable actuator to move the headbox in a second horizontal direction.

19. A method as claimed in claim 15 comprising the further step of locking the headbox in position after the headbox has been adjusted.

20. A method as claimed in claim 13 wherein said setting device adjustment step further comprises synchronously adjusting a pair of setting devices each positioned adjacent a respective transverse end of the headbox.

* * * * *

UNITED STATES PATENT AND TRADEMARK OFFICE

CERTIFICATE OF CORRECTION

PATENT NO. : 6,176,975 B1
DATED : January 23, 2001
INVENTOR(S) : Andersson et al.

It is certified that error appears in the above-identified patent and that said Letters Patent is hereby corrected as shown below:

Column 12,
Line 41, after actuator, delete the "," and insert --;--.

Column 14,
Line 26, after direction, insert --;--.

Signed and Sealed this

Fourteenth Day of August, 2001

*Attest:*

Nicholas P. Godici

*Attesting Officer*

NICHOLAS P. GODICI
*Acting Director of the United States Patent and Trademark Office*